US006964385B2

(12) United States Patent
Kelly

(10) Patent No.: US 6,964,385 B2
(45) Date of Patent: Nov. 15, 2005

(54) METHOD AND APPARATUS FOR HIGH THROUGHPUT CHARGE INJECTION

(75) Inventor: Arnold J. Kelly, Princeton Junction, NJ (US)

(73) Assignee: Charge Injection Technologies, Inc., Monmouth Junction, NJ (US)

( * ) Notice: Subject to any disclaimer, the term of this patent is extended or adjusted under 35 U.S.C. 154(b) by 0 days.

(21) Appl. No.: 10/138,095

(22) Filed: May 2, 2002

(65) Prior Publication Data

US 2003/0205629 A1 Nov. 6, 2003

(51) Int. Cl.[7] ..... B05B 5/00; F23D 11/32

(52) U.S. Cl. ..... 239/690; 239/690.1; 239/695; 239/969; 239/706

(58) Field of Search ..... 239/690, 690.1, 239/695, 696, 706, 707, 708, 558, DIG. 14, 239/3; 361/690

(56) References Cited

U.S. PATENT DOCUMENTS

| | | | | | |
|---|---|---|---|---|---|
| 3,767,116 | A | * | 10/1973 | Clausen et al. | 239/696 |
| 3,968,303 | A | * | 7/1976 | Harris | 428/332 |
| 4,255,777 | A | | 3/1981 | Kelly | |
| 4,273,293 | A | * | 6/1981 | Hastings | 239/705 |
| 4,613,075 | A | * | 9/1986 | Owen | 239/3 |
| 4,991,774 | A | | 2/1991 | Kelly | |
| 5,093,602 | A | | 3/1992 | Kelly | |
| 5,378,957 | A | | 1/1995 | Kelly | |
| 5,391,958 | A | | 2/1995 | Kelly | |
| 5,478,266 | A | | 12/1995 | Kelly | |
| 5,648,049 | A | * | 7/1997 | Jones et al. | 422/170 |
| 6,161,785 | A | | 12/2000 | Kelly | |
| 6,206,307 | B1 | | 3/2001 | Kelly et al. | |
| 6,227,465 | B1 | | 5/2001 | Kelly | |

* cited by examiner

*Primary Examiner*—Davis Hwu
(74) *Attorney, Agent, or Firm*—Lerner, David, Littenberg, Krumholz & Mentlik, LLP

(57) ABSTRACT

An apparatus for dispersing fluent material comprises a body defining a plurality of orifices arranged around a central axis and a charge injection device arranged on the central axis.

32 Claims, 12 Drawing Sheets

METHOD AND APPARATUS FOR HIGH THROUGHPUT CHARGE INJECTION

STATEMENT REGARDING FEDERALLY SPONSORED RESEARCH OR DEVELOPMENT

This invention was made with government support and the government has certain rights in the invention.

FIELD OF THE INVENTION

The present invention relates to electrostatic methods for dispersing fluent material and to apparatus for dispersing fluent materials.

BACKGROUND OF THE INVENTION

Electrostatic methods may be utilized in many applications, such as combustion of fuels and manufacture of fibrous materials.

Certain methods of electrostatic atomization of liquids are known. These methods use an electrode defining an orifice. The liquid is passed through the orifice, from a first side of the electrode to a second side. An oppositely charged surface is remotely disposed with respect to the electrode, on the second side of the electrode. These methods require large potential differences developed over the large air gap between the orifice and the charged remote surface. The electric field developed over the air gap is relied upon to develop the necessary charge within the fluid and disperse the fluid into droplets.

In certain embodiments, U.S. Pat. No. 4,255,777 discloses a system for atomizing fluids. As taught in certain embodiments of U.S. Pat. No. 4,255,777, the disclosure of which is hereby incorporated by reference herein, a fluid may be passed between a pair of opposed electrodes before discharge through the orifice. These opposed electrodes are maintained under differing electrical potentials, so that charges leave one of the electrodes and travel towards the opposite electrode through the fluid. However, the moving fluid tends to carry the charges downstream, towards the discharge orifice. Generally, the velocity of the fluid is great enough that most of the charges pass downstream through the orifice and do not reach the opposite electrode. Thus, a net charge is injected into the fluid by the action of the opposed electrodes. Systems according to certain embodiments of U.S. Pat. No. 4,255,777 can apply substantial net charge to the fluid and hence can provide superior atomization, as compared to the above-discussed known method.

The throughput for such devices can be important for commercial applications utilizing electrostatic methods, such as atomization of liquids, formation of fibers, or application of coatings. In addition, the efficiency and the even dispersal of the fluent material across a given area can be important. Despite considerable effort to develop electrostatic methods, further work is desirable.

SUMMARY OF THE INVENTION

The present invention addresses these needs.

In one aspect of the present invention, an apparatus for dispersing a fluent material comprises a body defining a plurality of orifices arranged around a central axis. A charge injection device is arranged on the central axis so that the orifices are arranged substantially equidistant from the charge injection device and the charge injection device imparts a net charge to a stream of fluent material delivered to the orifices. The charge injection device disperses the fluent material flowing to each of the orifices. Without subscribing to a particular theory of operation, it is believed that each of the orifices functions as an independent disperser of fluent material. It is also believed that arranging the orifices around the central axis and arranging the charge injection device on the central axis enables the fluent material flowing to each orifice to receive a net charge and disperse at least partially under the influence of the net charge.

In a preferred embodiment, the orifices are arranged in a circle around the central axis. The circle has a radius and a diameter. Each of the orifices has an exit on an exterior side of the body and the exit is preferably disposed on the circle. The exits of the orifices are spaced in a radial direction from the central axis a first distance of about the spacing of the charge injection device in the axial direction from the exits of the orifices. The exits of the orifices are disposed in a plane and the charge injection device is preferably spaced a distance from the plane, along the central axis, of about the radius of the circle. Arranging the orifices in a circular configuration is one preferred approach, as the orifices are equidistant from the charge injection device. However, other arrangements of orifices are contemplated by the invention. For example, the orifices may be arranged in an ellipse around the central axis.

The charge injection device may comprise an electrode, electron gun, electron beam generator, or other such device. The charge injection device may comprise an electrode mounted within the body so that an end surface of the electrode is disposed adjacent the orifices. The end surface of the charge injection device may comprise an edge disposed in alignment with the orifices. The edge, in certain preferred embodiments, comprises a plurality of projections having ends facing the orifices. Without being limited to a theory of operation, it is believed that the end surface of the charge injection device near the central axis should be further away from the body of the device than the edge, which is in alignment with the orifices. It is believed that net charge from the end surface of the charge injection device near the central axis has a greater tendency to be conducted away from the fluent material through the body of the device than the edge in alignment with the orifices. It has been found that a concave end surface on the charge injection device improves operation of the apparatus. It has also been found that providing a plurality of projections at the edge of the charge injection device, also improves the operation of the apparatus.

The body may have an interior chamber and an insulator may be disposed in the interior chamber so as to form a forward chamber adjacent the orifices. The charge injection device may comprise an electrode mounted within the insulator. The insulator may be disposed within the body so as to form a distribution channel leading to the forward chamber. The body may include an aperture in communication with the distribution channel for delivering a fluent material to the distribution channel. The distribution channel is arranged to deliver fluent material to the orifices.

The orifices each have an entrance on an interior side of the body and an exit on an exterior side of the body. In certain preferred embodiments, the entrance is positioned equidistant from the charge injection device. Each of the orifices preferably has a centerline that extends through the entrance and the exit. In certain preferred embodiments, the centerline is oblique to the central axis so that the orifices have a canted arrangement with respect to the central axis of the apparatus. In certain embodiments, the canted arrangement projects the dispersed fluent material into the space surrounding the apparatus.

In certain preferred embodiments, the centerlines of the orifices intersect with one another. The orifices may include a first orifice on a first side of the central axis and a second orifice on a second side of the central axis, opposite the first side. The centerline of the first orifice may define an angle with the centerline of the second orifice.

The body of the apparatus may comprise a forward wall and the orifices may be formed in the forward wall. In certain preferred embodiments, the forward wall includes a recess disposed on the central axis, between the orifices, on an interior side of the body. In certain preferred embodiments, the interior side of the forward wall in-between the orifices comprises a dielectric material. Without being limited to a theory of operation, it is believed that a conductive surface located between orifices, on an interior side of the forward wall, may decrease the effectiveness of the apparatus. It is believed that net charge imparted to the fluent material may be conducted away from the fluent material through the surface on the interior side of the forward wall. It has been found that providing a recess or a dielectric material at this location improves the functioning of the apparatus.

The forward wall may be planar in shape or may have a conical, convex, concave, or angled shape. In certain embodiments, the forward wall comprises a planar forward wall that is arranged perpendicularly with respect to the central axis. Each of the orifices has a diameter. The spacing of the orifices in the planar forward wall preferably comprises at least about twice the diameter of each said orifice. In certain embodiments, the orifices have a circular shape. However, the orifices may also comprise orifices that have other shapes. The orifices may comprise orifices having the shape of any polygon or any oval. For example, the orifices may comprise rectangular-shaped orifices or slits. In non-circular orifices, the spacing comprises at least about twice a dimension of the orifice.

In certain other embodiments, the forward wall comprises a wall with a conical shape. The longitudinal axis of the conical shape is concentric with the central axis for the apparatus. The forward wall may comprise a notch in which the orifices are formed. Each of the orifices has a diameter, or in the case of non-circular orifices, a dimension. The spacing of the orifices in the conical forward wall comprises at least about three times the diameter of the orifices. More preferably, the spacing of the orifices in the forward wall comprises at least about four times the diameter. In other embodiments, the spacing of non-circular orifices comprises at least about three times the dimension of the orifices; more preferably, four times the dimension of the orifices.

In certain embodiments, the at least one passage includes an interior space adjacent the orifices. A counterelectrode is disposed in the vicinity of the orifices and a dielectric structure is disposed between the counterelectrode and the interior space. The counterelectrode is preferably electrically insulated from the interior space. Apparatus according to this aspect of the invention can suppress the generation of large soot particles that can cause clogging of the orifices. Structures that can be used include those disclosed in certain embodiments of U.S. application Ser. No. 09/476,246, filed Dec. 10, 1999, the disclosure of which is hereby incorporated by reference herein.

In another embodiment, the body defines a plurality of interior spaces. Each interior space has a charge injection device and a plurality of orifices associated with the charge injection device. The orifices extend through the body to the interior spaces. The interior spaces are preferably devoid of exposed electrically conductive surfaces other than at the charge injection device. In this aspect of the invention, a device for high throughput generation of dispersed fluent material is realized.

In a preferred embodiment, the apparatus includes a power source arranged with said charge injection device to vary the net charge imparted to the fluent material cyclically in accordance with a pattern of variation so that the net charge injected repeatedly increases and repeatedly decreases. The net charge injected may be increased by the power source above a long-term breakdown value and repeatedly decreased below a long-term breakdown value. The power source increases and decreases the net charge injected to reduce the incidence of corona-induced breakdown of the apparatus. Such apparatus may be constructed as disclosed in certain embodiments of U.S. Pat. No. 6,227,465, the disclosure of which is hereby incorporated by reference herein.

In a preferred embodiment, the power source is arranged to vary the net charge imparted to the fluent material so that a higher value of net charge is imparted for a first interval and a lower value of net charge is imparted for a second interval. In another embodiment, the orifices include at least one first orifice closer to the charge injection device than at least one second orifice and the net charge imparted to the fluent material is varied so that the fluent material issuing from the at least one second orifice is dispersed. The power source may be arranged to vary an operating voltage applied to the charge injection device.

In another aspect of the present invention, a method of dispersing a fluent material comprises passing a fluent material out a plurality of orifices arranged around a central axis. A net charge is applied to the fluent material by passing the fluent material past a charge injection device arranged on the central axis so that the fluent material passing out of each of the orifices is dispersed under the influence of the net charge.

In a preferred embodiment, the step of applying a net charge includes varying the net charge so that the net charge imparted to the fluent material repeatedly increases and decreases. The net charge is desirably varied so that a higher value of net charge is imparted to the fluent material for a first interval and a lower value of net charge is imparted to the fluent material for a second interval. The net charge may be varied by varying an operating voltage applied to a charge injection device.

In a preferred embodiment, the orifices include at least one first orifice closer to the charge injection device than at least one second orifice and the net charge is varied so that the fluent material issuing from the at least one second orifice is dispersed. Without being restricted to any theory of operation, it is believed that an orifice located further away from the charge injection device than other orifices will issue fluent material somewhat less disbursed than the other orifices. However, by varying the net charge imparted to the fluent material flowing to the orifice located further away from the charge injection device will improve operation of the device.

BRIEF DESCRIPTION OF THE DRAWINGS

These and other features, aspects and advantages of the present invention will become better understood with regard to the following description, appended claims and accompanying drawings where:

DETAILED DESCRIPTION

Figure 1:
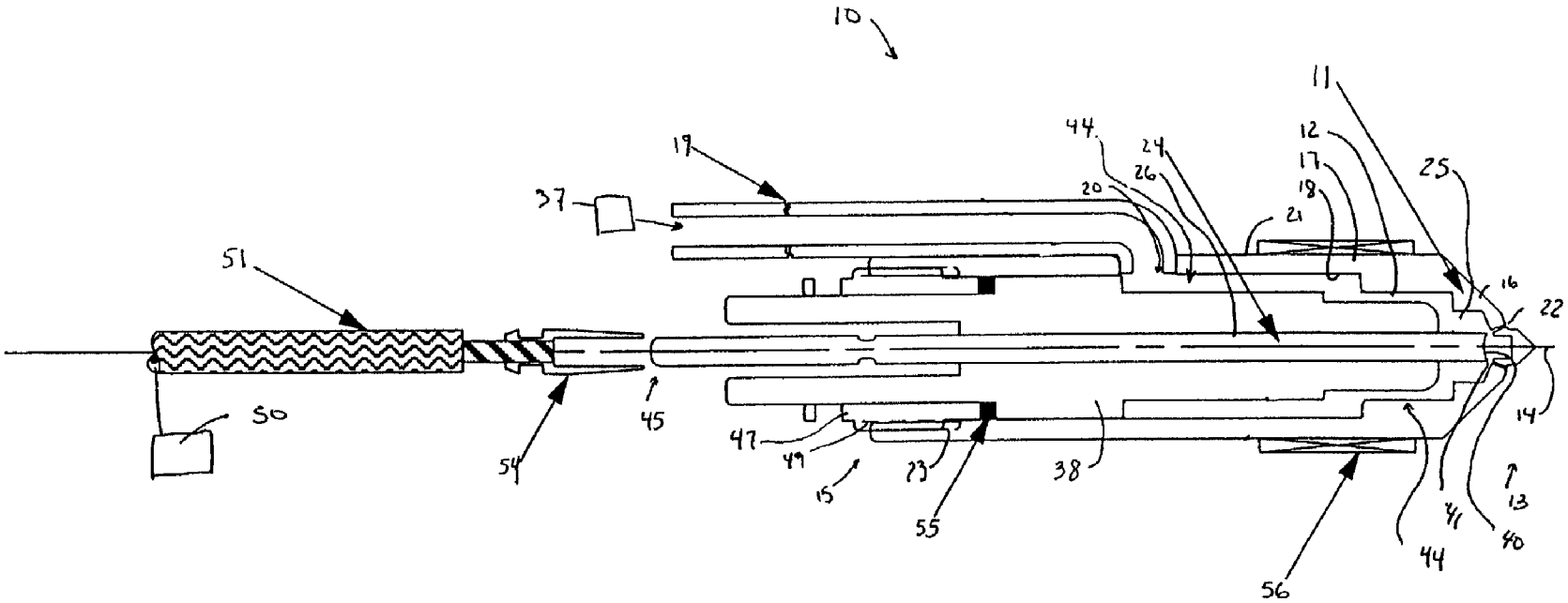
FIG. 1 is a cross-sectional view of an apparatus in accordance with an embodiment of the invention.

An embodiment of the invention is shown in FIGS. 1–5. A dispersing apparatus 10 comprises a body 11 having a central axis 14. The body 11 may comprise an electrically conductive body, such as a metallic body 11. The body 11 may also comprise a ceramic or plastic body 11.

A liquid supply line 19 is attached to the body 10 at an aperture 20 in the body 11. The body 11 is generally cylindrical and formed by a wall 17 with an interior surface 18 and an exterior surface 21. The body 11 shown in FIG. 1 has a generally cylindrical shape, but a dispersing apparatus 10 in accordance with embodiments of the invention may have various shapes. The shape of the body 11 is not essential.

Figure 2:
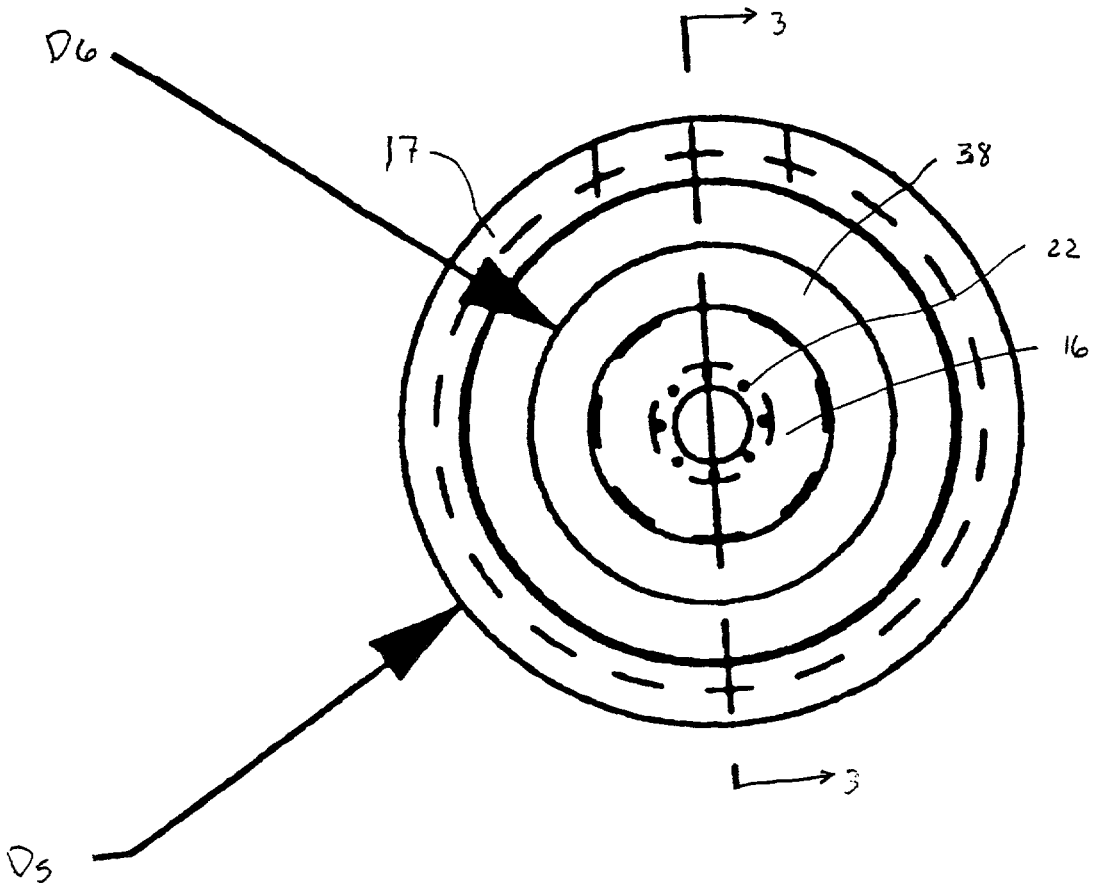
FIG. 2 is a cross-sectional view of the apparatus taken along line 2—2 in FIG. 3, excluding the insulating support shown in FIG. 3.
Figure 3:
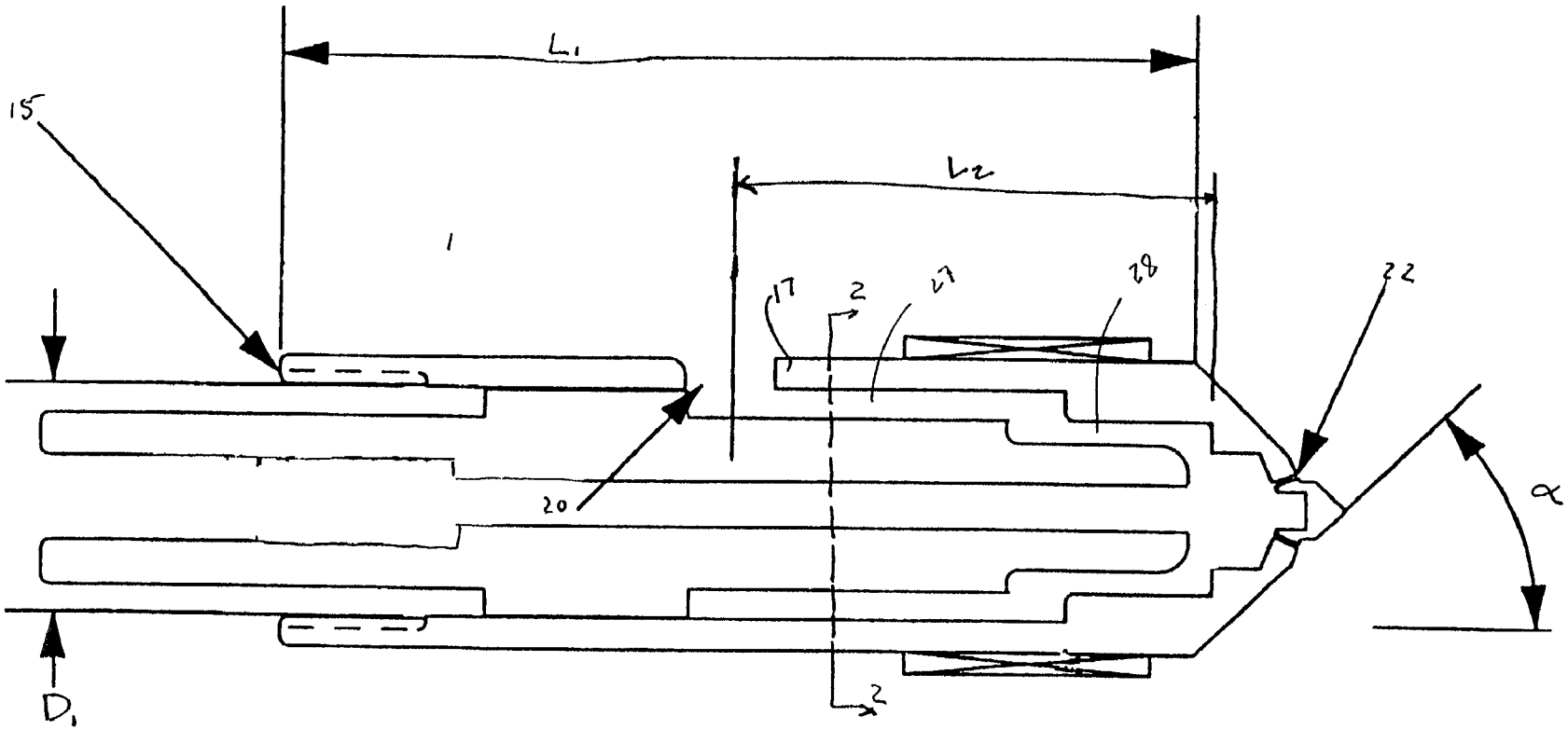
FIG. 3 is a cross-sectional view taken along line 3—3 in FIG. 2.

The body 11 defines a first end 13 and a second end 15, opposite from first end 13. The wall 17 tapers towards the first end 13 to a generally conical forward wall 16 at the first end 13 of the apparatus. The forward wall 16 has at least two orifices formed therein. For example, in the embodiment shown, eight orifices 22 are formed in forward wall 16 so that they are substantially equidistant from central axis 14. The orifices 22 shown in FIG. 2 are circular in shape. However, orifices of any shape may be used. For example, the orifices may have the shape of any polygon, such as generally rectangular slits, or oval, or any irregular shape.

Where the body 11 is comprised of a dielectric material, the body 11 includes a metallic surface in the area around the orifices 22. For example, the body 11 may comprise a ceramic body 11, with a layer of metal or other conductive material on an exterior side of the body, around the orifices 22. The body 11 is open at second end 15, and has interior threads 23 at the open second end 15.

The interior surface 18 of the body 11 defines a central chamber 12 and an electrically insulating support 38 is disposed within the central chamber 12. The interior surface 18 has a stepped configuration so that the body 11 and insulator 38 define a distribution channel 44 leading to a forward chamber 25 that communicates with a recess 32, adjacent forward wall 16. Insulator 38 is generally cylindrical and coaxial with the body 11. Although insulator 38 is shaped to be received in the central chamber 12, the shape of the insulator 38 is not essential. Insulator 38 may be formed of any substantially rigid dielectric material, such as a glass, non-glass ceramic, thermoplastic polymer or thermosetting polymer. The liquid distribution channel 44 communicates with the supply line 19 and receives a fluent material from a fluent material source 37 connected to supply line 19. The fluent material flows through distribution channel 44 to the forward chamber 25 and to the orifices 22.

A charge injection device 24 is arranged on central axis 14. The charge injection device 24 may comprise an electrode having an end surface 40. The electrode may comprise electrodes incorporating conductive materials such as any metal, including tungsten or zirconium, setaceous surfaces, reconstituted oxide-metal composites (ROMC), metallic materials or metal or conductive coatings.

The electrode end surface 40 preferably has an edge 41 for emitting electrons. The electrode 26 is mounted within insulator 38 so that the edge 41 is in alignment with the orifices 22. An end nut 47 having external threads 49 is inserted into the central chamber 12, engaging the internal threads at second end 15 of the body 11 and engaging an edge of the insulator. The end nut 47 facilitates a seal between the insulator 38 and the end nut, and firmly mounts the electrode 26 and insulator 38 within the body 11. A washer 55 may be disposed between the end nut and the insulator.

Figure 10A:
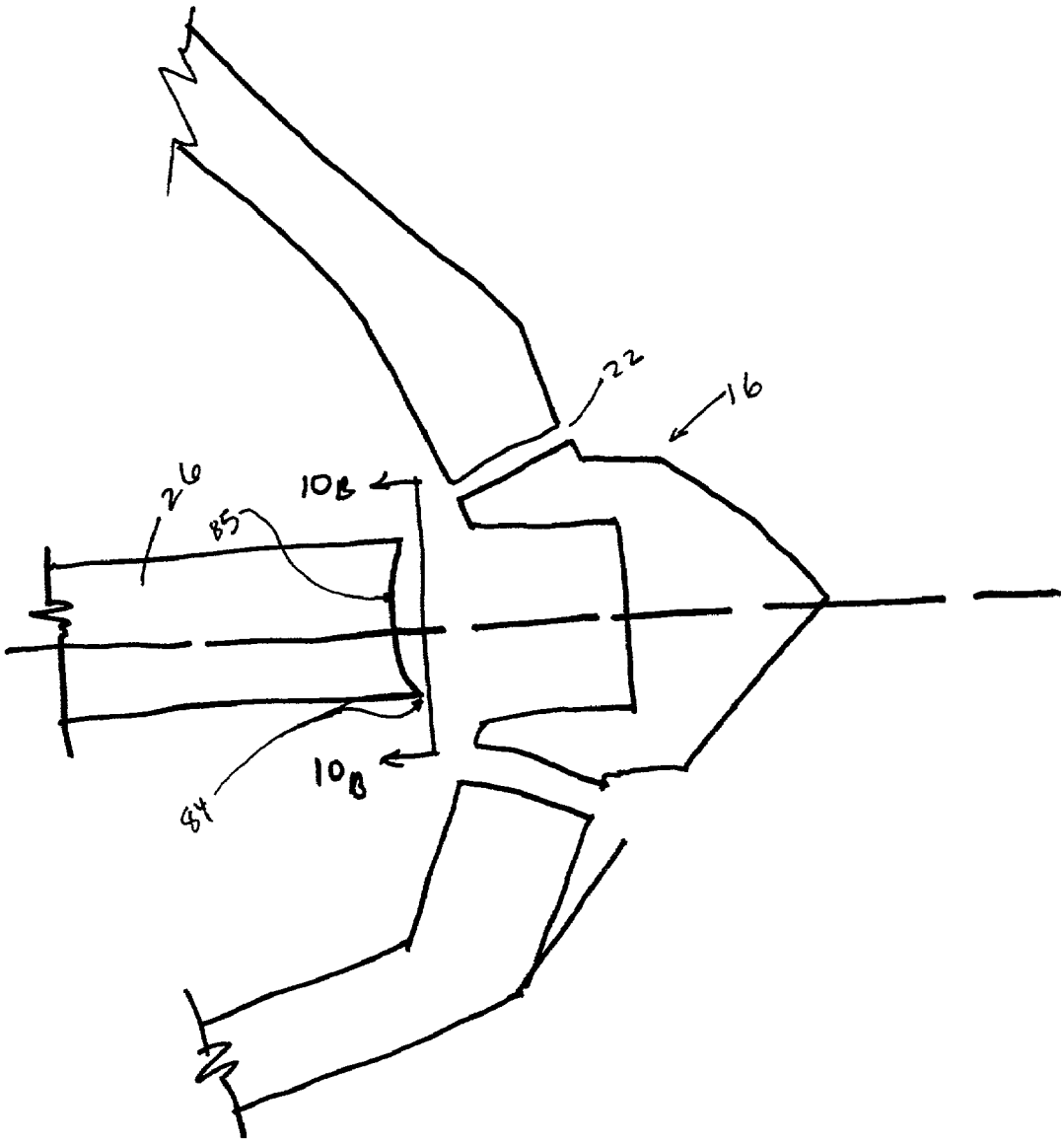
FIG. 10A is a detail, viewed in section, of a portion of an apparatus in accordance with a further embodiment of the invention.
Figure 10B:
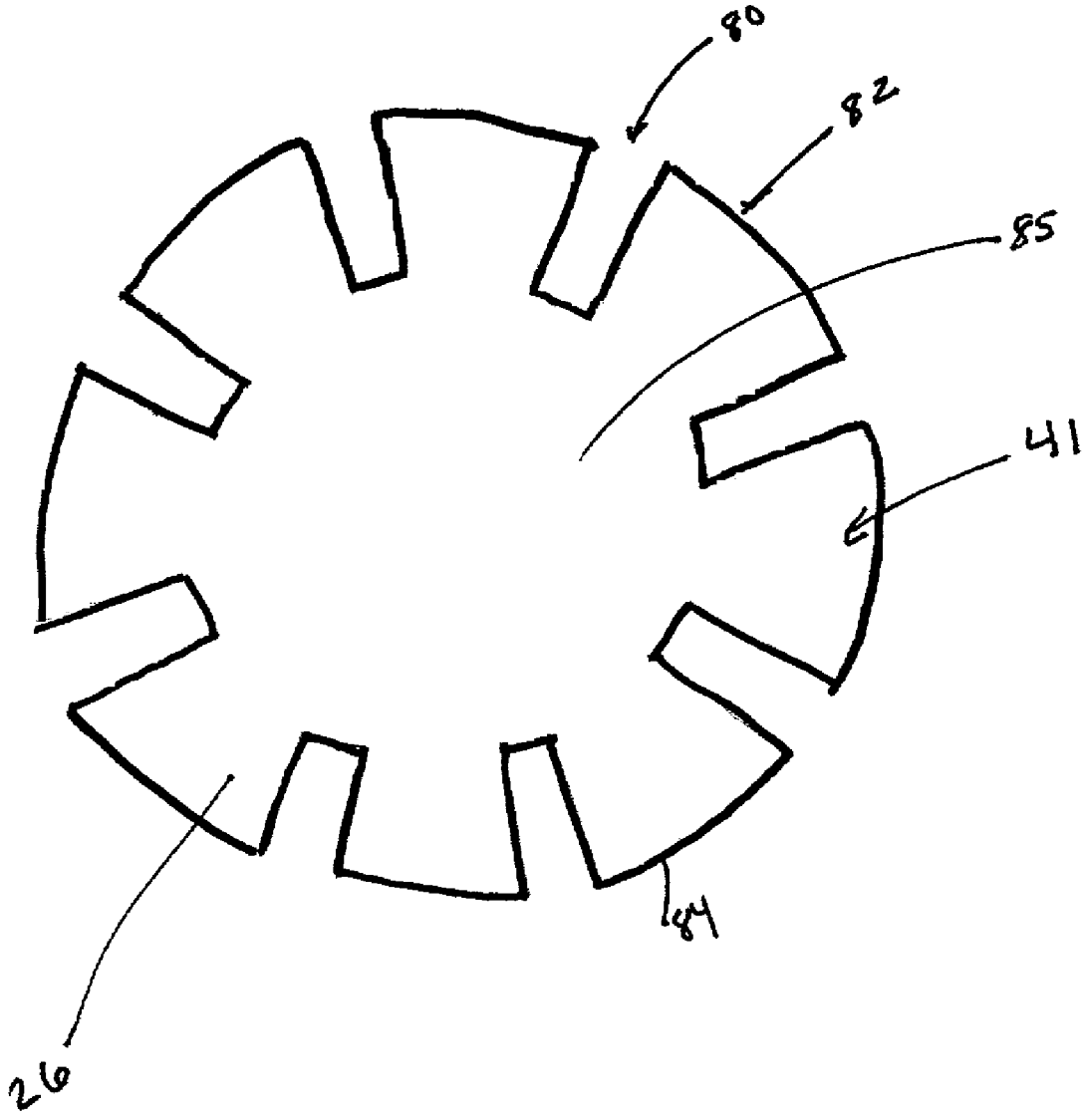
FIG. 10B is the cross-sectional view taken along line 10B—10B in FIG. 10A.

In one preferred embodiment, the electrode comprises an edge 41 aligned with the orifices. The edge 41 is formed by a plurality of finger-like projections 82 having ends 84 that face the orifices 22. (FIGS. 10A and 10B). The projections are formed from an electrode 26 having a concave surface 85 that is sliced to form the fingers, forming an electrode having a crown-shaped end. The electrode 26 may be formed using a number of techniques, such as photolithographic techniques used in semiconductor manufacturing. The electrode 26 may be formed by machining the electrode under a microscope, using a small razor-like blade to form slices 80 and projections 82. In other embodiments, separate smaller emitters are aligned with each orifice. In other embodiments, an electrode with a conical tip is used.

Figure 5:
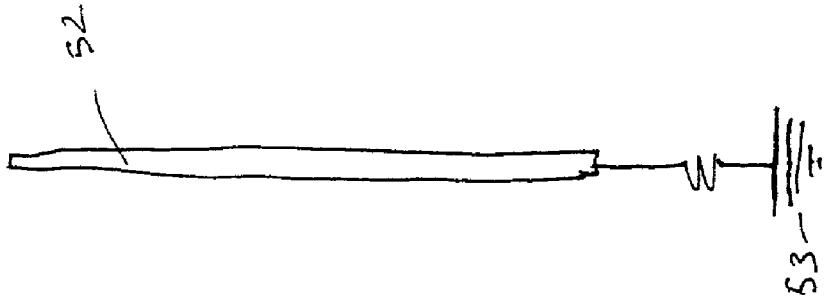
FIG. 5 is a cross-sectional view of an end of the apparatus in accordance with the embodiment of FIGS. 1–4B.
Figure 5:
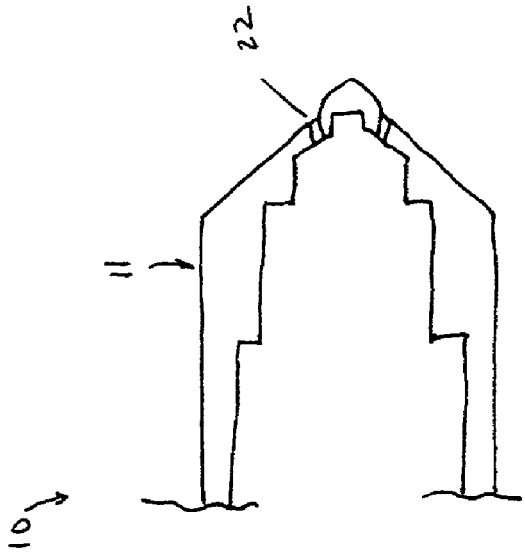

A high voltage wire 51 is attached to a high voltage potential source 50 and has a clip 54 for connecting to the electrode, as where a back end 45 of the electrode 26 projects from the insulator 38. The end surface 40 is connected to the source 50 for generating a charge and imparting the fluent material with a charge. A conductive collector structure 52 is disposed remote from body 11, generally facing forward wall 16. The collector structure 52 is attached to a ground 53. (FIG. 5). The collector structure 52, in certain embodiments, communicates with a combustion chamber in a combustion device incorporating the dispersing apparatus 10. The collector structure may comprise a generally cylindrical wall surrounding the body 11 and forming an airflow channel leading to a combustion chamber. In such embodiments, fuel is delivered to the apparatus 10 through liquid supply line 19, and atomized fuel is projected from orifices 22 into the airflow. In certain embodiments, external vanes are provided integrally with the wall 17 so as to project from an exterior surface 21 of the body 11 into the airflow channel. The apparatus need not be used with the airflow channel, a combustion chamber, or the vanes 56. The apparatus may be used inside the combustion chamber without an airflow channel. The dispersing apparatus 10 may be used in a variety of other contexts.

In other embodiments, the collector structure 52 comprises a ground electrode in the form of a flat plate, as schematically shown in FIG. 5. The geometric form of the structure 52 is not critical. In other embodiments, the structure 52 comprises an electrode in the form of a drum. Where the dispersed fluent material is directed into an enclosure, the collector structure 52 may comprise a wall of the enclosure.

The collector structure 52 is attached to a ground 53 and is spaced from forward wall 16 of the body 11. Dispersed fluent material is directed towards the ground electrode from the orifices 22. The high voltage source 50 and body 11 are connected to the ground 53. The foregoing components of the dispersing apparatus may be generally similar to the corresponding components of the apparatus called the SPRAY TRIODE® atomizer, disclosed in certain embodiments of U.S. Pat. No. 4,255,777, the disclosure of which is hereby incorporated by reference herein.

The forward wall 16 in the embodiment shown in FIGS. 1–5 has a conical shape. The forward wall 16 includes a notch 35 in which the orifices 22 are formed. Each orifice 22 has an entrance 60 at an interior side of the forward wall 16, opening on the forward chamber 25. An exit 62 of each orifice 22 is located on an exterior side of the forward wall 16.

Figure 4A:
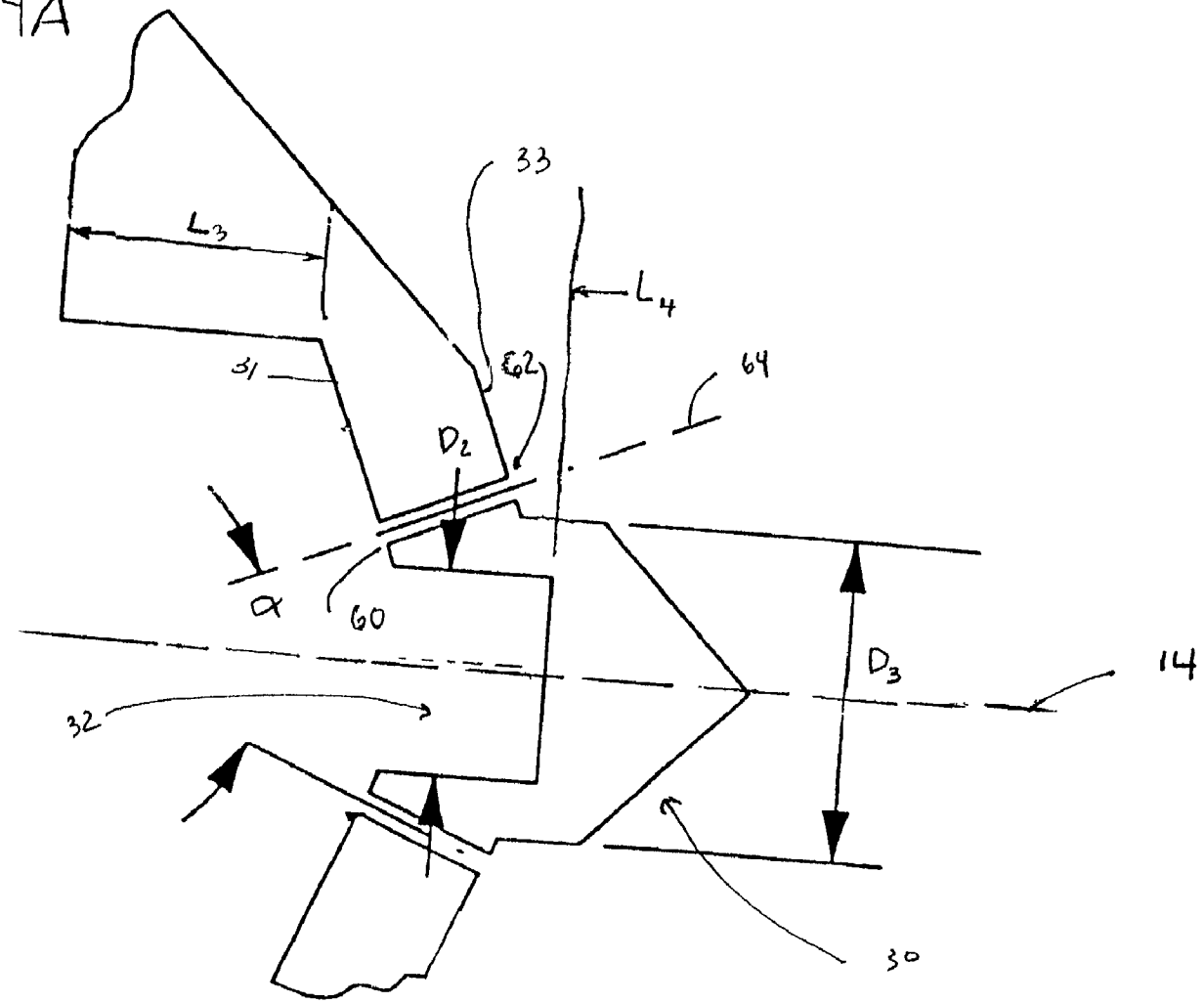
FIG. 4A is a detail, viewed in section, of a portion of an apparatus in accordance with the embodiment of FIGS. 1–3.

Each orifice has a centerline 64, located centrally within the entrance 60 and within the exit 62. The centerline 64 preferably extends in a straight line through the orifice. In certain preferred embodiments, the orifices 22 have a canted arrangement with respect to the central axis 14, as best seen in FIG. 4A. The orifices 22 are formed in forward wall 16 so that each centerline 64 is arranged transversely with respect to the central axis 14. One benefit of orifices with a canted arrangement is that the fluent material is dispersed in a wide spray surrounding the central axis 14. As best seen in FIG. 4A, the canted orifices 22 have entrances 60 that are closer to the edge 41 of the electrode than the exit 62 of the orifice 22. In preferred embodiments, the entrances 60 of the orifices 22 are positioned adjacent, and in close relation with the edge 41 on the electrode 26. Preferably, the entrances 60 of the orifices 22 are substantially equidistant from the charge injection device 24.

In certain embodiments, it may be desirable to build a compact dispersing apparatus. For example, in the apparatus seen in FIG. 3, the body 11, excluding the conical end, has a length L1 of about 31 millimeters and the aperture 20 is a hole in the wall 17 that has a diameter of about 3 millimeters. The liquid distribution channel 44, extends a distance $L_2$ of about 16 millimeters from the center of the aperture 20 to the forward chamber 25. As best seen in FIG. 4A, the forward chamber 25 extends from the liquid distribution channel 44 a distance $L_3$ of about 1.6 millimeters into the tip 30 of the body 11 at first end 13. (FIG. 4A) The body 11 includes a wall defining an angled or curved interior surface 31 extending from the forward chamber 25 to a recess 32 in the tip 30 of the body. The recess 32 has a diameter D2 of about 1.3 millimeters. The terminus of the recess 32 is located a distance $L_4$ of about 3 millimeters from the end of the forward chamber 25. The orifices 22 are located in the forward wall 16, with the recess 32 in-between the orifices. The orifices each have a diameter of about 200 micrometers. The recess 32 is not essential to the invention. The recess removes a portion of the interior surface of the body 11 from the vicinity of the orifice. If this surface is conductive, the charge imparted to the fluent material can be conducted away from the fluent material to the conductive body 11. If the body 11 is formed from conductive material, a recess 32 between the orifices reduces the tendency of this surface of the body 11 to conduct charge away from the fluent material. In other embodiments, the surface on the interior side of the body 11, between the orifices 22, is comprised of a dielectric material. A recess 32 may be formed and filled with a dielectric material, or the body 11 may be dielectric, as discussed above.

In embodiments having a conductive body 11, the recess 32 may be omitted, or used in combination with, other features. For example, the use of an electrode with a crown-shaped edge, such as the edge 41 shown in FIGS. 10A and 10B, tends to conduct less charge to the interior surface of the body between the orifices. In addition or in the alternative, the apparatus may include a power source having a varying voltage to reduce the tendency of the charge to be conducted away from the fluent material. Such apparatus are disclosed in certain embodiments of U.S. Pat. Nos. 6,206,307 and 6,227,465, the disclosures of which are hereby incorporated by reference herein.

A dispersing apparatus according to embodiments of the invention can be fabricated using micro-mechanical fabrication techniques, and techniques used for forming semiconductor chips and related devices. Photo-etching techniques, plating, vacuum deposition or other conventional techniques used in semiconductor fabrication may be used. The emitter electrodes can be formed by etching and/or deposition. For example, tungsten emitters can be formed by sputtering, by vapor deposition or by chemical vapor deposition.

In a preferred embodiment, the centerlines 64 of each orifice define an angle $\alpha 1$. In the embodiment shown in FIGS. 1–5, $\alpha 1$ is between about 44.5° and 45.5°, or about 45°. In a preferred embodiment, the entrances 60 for each orifice 22 are positioned equidistant from the central axis 14. In a preferred embodiment, the exits 62 of the orifices are equally spaced on a circle that is concentric with the central axis 14. In the embodiment shown, the exits 62 are disposed on a circle having a diameter of between about 2.35 and about 2.45 millimeters, or about 2.4 millimeters. In the embodiment shown, each orifice has a diameter of between about 190 and about 210 micrometers, or about 200 micrometers.

The particular dimensions of the device will depend upon the particular context and application in which the device will be used. In other embodiments, the device has dimensions that are different. The dimensions may be smaller or larger and a person of ordinary skill can construct a dispersing apparatus in accordance with the invention for various contexts. For example, in other embodiments, a larger body 11, having larger distribution channels 44, is used. It may be desirable to use larger orifices 22, or fewer or more orifices, in other embodiments. In addition, the orifices may or may not be equally spaced around a central axis, or equidistant from a central axis.

Without committing to any particular theory of operation, the inventor has found that providing the plurality of orifices substantially equidistant from the charge injection device 24 enables each orifice to function as an independent atomizer, although only a single charge injection device 24 is utilized. Variations in distance between the emitter and the orifices results in differences in the amount of charge injected into the stream of fluent material flowing to each orifice. The larger the distance from the charge injection device, the lower the charge injected in the fluent material traveling to the particular orifice, and the less dispersion that will be achieved utilizing embodiments in accordance with the present invention.

Figure 11:
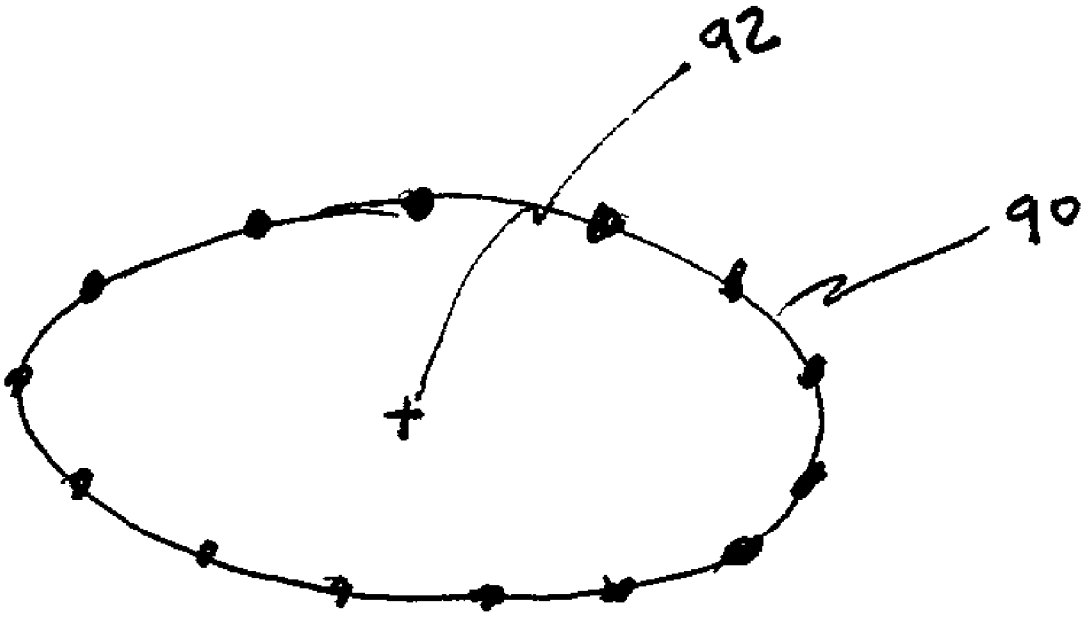
FIG. 11 is a cross-sectional view of an apparatus in accordance with a further embodiment of the invention.

Preferably, the orifices are arranged on a circle that is concentric with the central axis. The circle on which the orifices are arranged has a radius. The exits 62 of the orifices are spaced in a radial direction from the central axis, and the charge injection device is spaced from the exits in an axial direction, along the central axis. The end surface of the charge injection device is preferably spaced a distance in the axial direction of about the radius ("R") of the circle. In embodiments in which the orifices are formed in a planar wall, the spacing between the orifices is preferably about twice the diameter of the orifices. In embodiments in which the orifices are formed in a conical wall, the spacing of the orifices is preferably at least about three times the diameter of the orifices and, more preferably, at least about four times the diameter of the orifices. In other embodiments, the orifices are arranged on an ellipse 90 having a center 92, as shown in FIG. 11. The charge injection device 24 is arranged on a central axis that passes through the center 92. The arrangement of the orifices around the central axis 14 may have other configurations.

The charged injection device may comprise an emitter electrode, an electron gun, an electron beam generator and a variety of other devices for imparting a charge to a fluent material. For example, the charge injection device can comprise an electron gun arranged with the orifices so that electrons in the electron beam impinge on the fluent material, either as it issues from the orifice, or just before the stream of fluent material passes through the orifice. Such devices include those disclosed in certain embodiments of U.S. Pat. Nos. 5,378,957, 5,093,602, 5,391,958, the disclosures of which are hereby incorporated by reference herein.

Fluent materials that can be dispersed utilizing an apparatus according to the present invention, include liquids such as fuels, molten polymers, polymer solutions and other liquids. The fluent material may comprise a liquid fuel that is atomized for combustion within the apparatus. Other fluent materials may be disrupted utilizing apparatus according to the invention. For example, fluent materials such as fluent solid particulate materials may be electrostatically disbursed. As used herein, the term "a dispersion" and the "dispersing" should be understood broadly, as encompassing both dispersion of solid particulate material and atomization of a liquid. Among other uses, disbursed solid particles are used in pharmaceutical preparation and the application of coatings to various articles. In further embodiments, a fluent material comprising a liquid molten polymer or polymer solution is dispersed in a dispersing apparatus according to embodiments of the invention to produce fibers. Apparatus in accordance with the present invention include charge injection devices described in certain embodiments of U.S. Pat. Nos. 4,255,777, 4,991,774, 5,093,602, 5,378,957, 5,391,958, and 5,478,266, the disclosures of which are hereby incorporated by reference herein. Certain preferred embodiments of the present invention include charge injection devices having features disclosed in certain embodiments of U.S. Pat. No. 6,161,785, U.S. patent application Ser. No. 09/430,633, filed Oct. 29, 1999, Ser. No. 09/430,632, filed Oct. 29, 1999, and Ser. No. 09/476,246, filed Dec. 30, 1999, the disclosures of which are all hereby incorporated by reference herein.

Figure 4B:
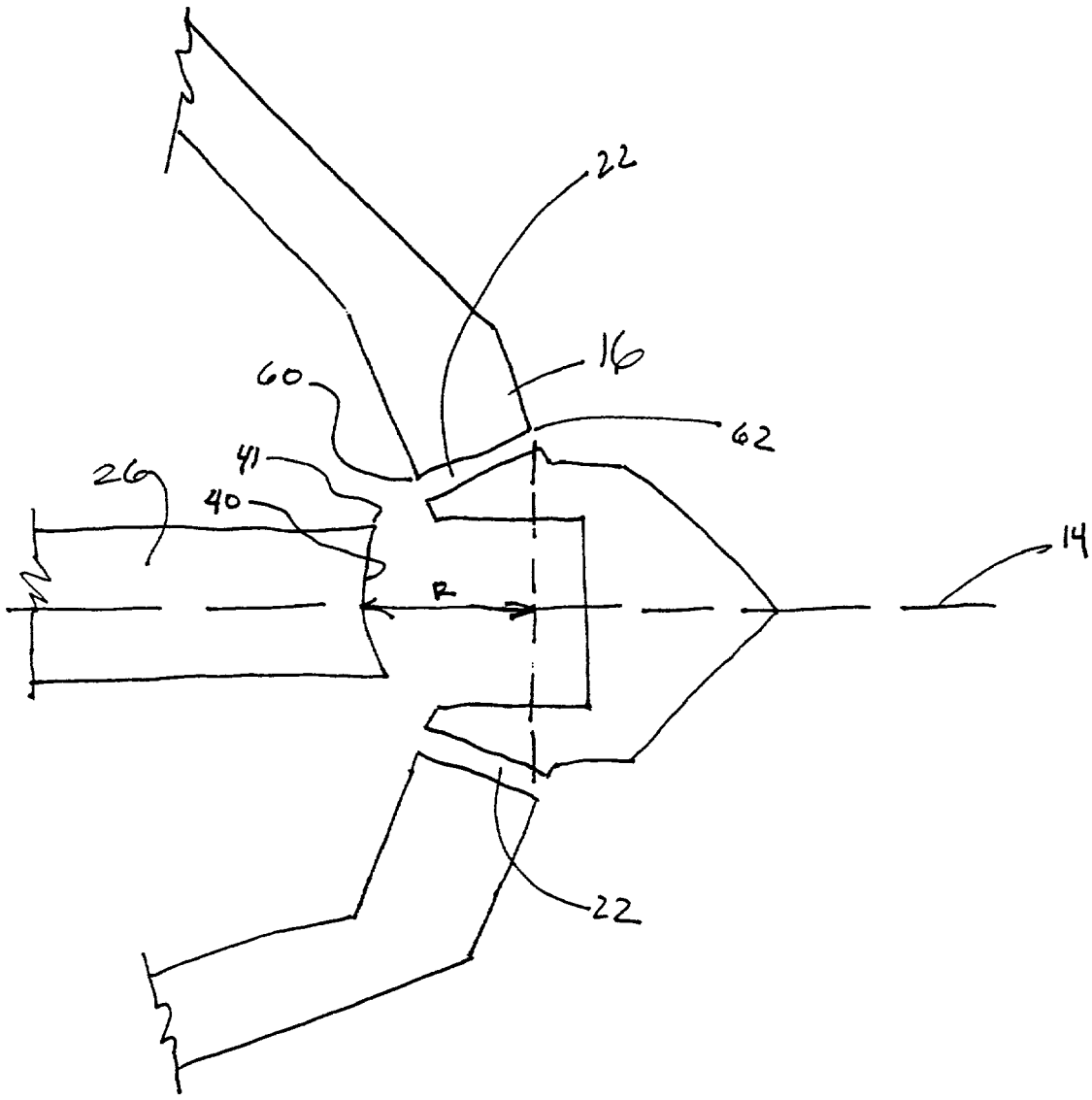
FIG. 4B is the detail of FIG. 4A showing an end of the apparatus in accordance with the embodiment of FIGS. 1–4A.
Figure 6:
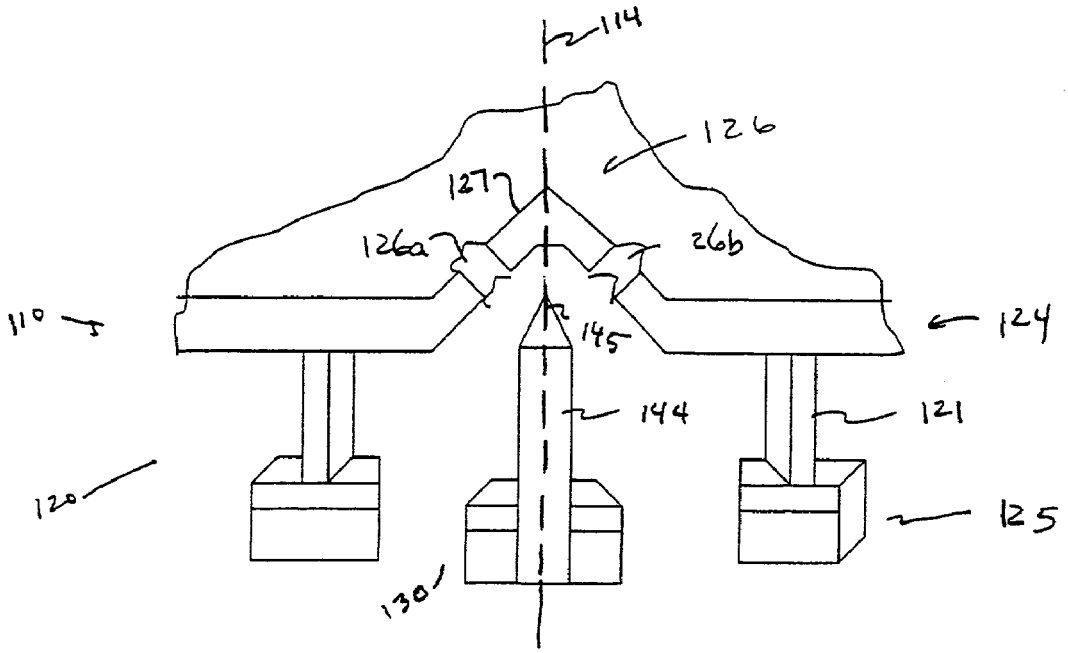
FIG. 6 is a cross-sectional view, taken along line 6—6 in FIG. 7, of an apparatus in accordance with another embodiment of the invention.
Figure 7:
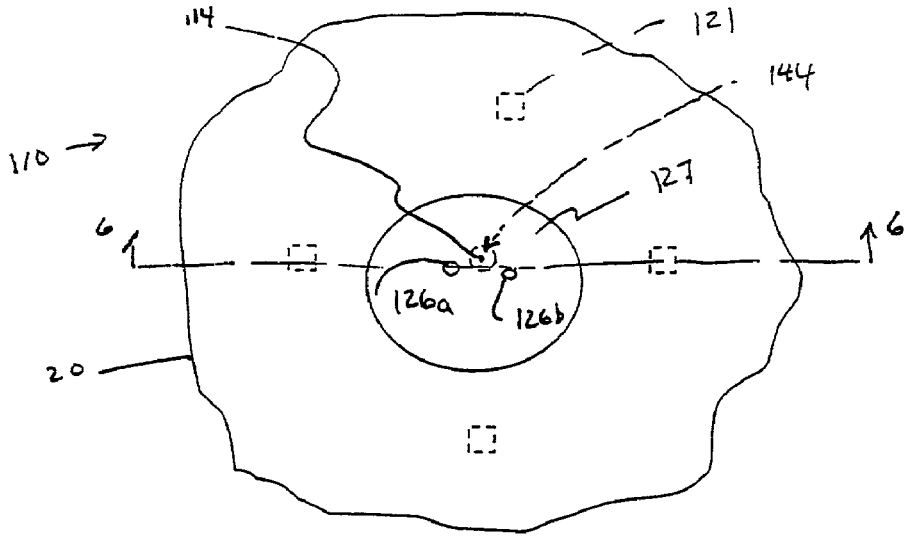
FIG. 7 is a top plan view of an apparatus in accordance with the embodiment of FIG. 6.

In a further embodiment of the invention, the dispersing apparatus 110 comprises a body 120 having a first wall 124 and a second wall 125. As shown in FIGS. 6 and 7, the first wall 124 forms a conical end 129 in which a pair of orifices 126 are formed. The pair of orifices 126 are aligned on an axis 114 with an emitter electrode 144. The emitter electrode 144 may comprise an electrode having a tip 145, as shown in FIG. 6, or may comprise an electrode with an edge, with or without fingers 82, as shown in FIGS. 4B, 10A and 10B. Other types of electrodes and other types of charge injection devices may be used. The emitter electrode 144 is arranged so that the tip 145 faces the pair of orifices 126. The conical end 129 has a slanted surface. The orifices each have a centerline 164 and the orifices are formed in the first wall 124 so that the centerlines 164 are transverse to the axis 114 and each orifice. A passage 130 communicates with the space in which the electrode 144 is disposed. The passage 130 allows a fluent material to be delivered to the space so that the fluent material flows to the orifices 126 and the electrode 144 imparts a charge to the fluent material. The apparatus 110 may generally be constructed as disclosed in certain embodiments of U.S. patent application Ser. No. 09/476,246, the disclosure of which is hereby incorporated by reference herein.

The first wall 124 preferably comprises a dielectric layer 124*a* and a layer of conductive material 124*b* such as a layer of metal, on the dielectric layer 124*a*. Second wall 125 may be comprised of an insulative material, or may incorporate a dielectric layer 127 and a conductive layer 123 electrically connected to the emitter electrode 144, as disclosed in certain embodiments of U.S. application Ser. No. 09/476,246, filed Dec. 30, 1999, the disclosure of which is hereby incorporated by reference herein. In certain embodiments, a filter may be incorporated in the second wall 125. The passage 130 may comprise an aperture on apertures in second wall 125.

Figure 8:
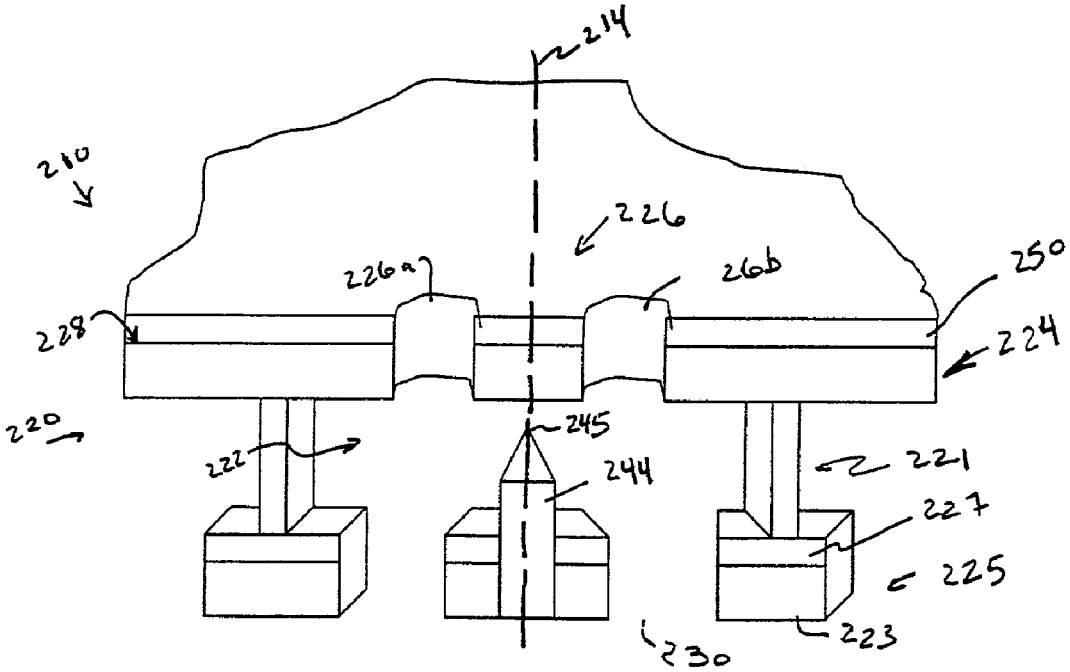
FIG. 8 is a cross-sectional view, taken along line 8—8, of an apparatus in accordance with a further embodiment of the invention.
Figure 9:
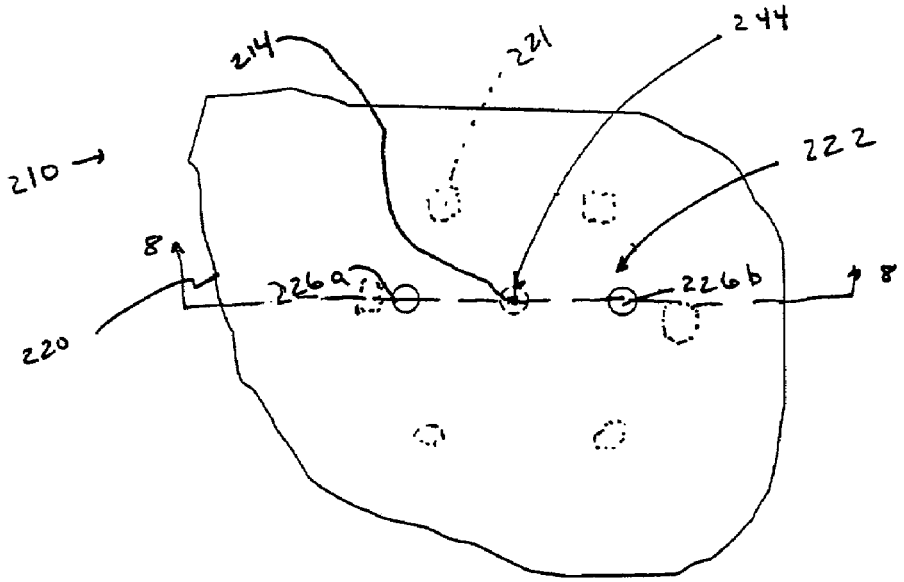
FIG. 9 is a top plan view of an apparatus in accordance with the embodiment of FIG. 8.

The canted arrangement of the orifices is not essential. In a further embodiment of the invention, the apparatus has more than one orifice formed in a flat wall. In the embodiment of FIGS. 8 and 9, the dispersing apparatus 210 comprises a body 220 having a first wall 224 and a second wall 225 generally parallel to the first wall but spaced therefrom. The first wall 224 defines a plurality of discharge orifices 226 arranged around an axis 214 with a charge injection device. In the embodiment shown, the charge injection device comprises an emitter electrode 244 arranged with a pair of orifices 226 in the first wall 224. The emitter electrode 244 has a tip 245 and is arranged so that the tip 245 faces the pair of orifices 226. The electrode 244 may also comprise an electrode having an edge, with or without the projections, as shown in FIGS. 4B, 10A and 10B.

In certain embodiments, the first wall 224 comprises a dielectric material. An external electrode 250 is formed on an exterior surface 228 of the first wall 224, as by electroplating or other methods, such as methods used in semiconductor manufacture. An insulating internal structure 221 supports first wall 224 and second wall 225 in a spaced relation. In certain preferred embodiments, the body 220 incorporates a plurality of emitter electrodes. In such embodiments, more than one orifice 226 may be arranged per electrode. For example, an array of electrodes are arranged with more than one orifice for each electrode. In such embodiments, the structure 221 forms an internal space 222 for each electrode, each internal space 222 communicating with the pair of orifices 226. The structure 221 includes a passage 230 that communicates with the internal spaces 222 and delivers fluid to the spaces 222. In other embodiments, the body 220 forms a dispersing device having one emitter electrode and one internal space 222 communicating with a passage 230 and a plurality of orifices 226.

In FIGS. 6–9, circular orifices are shown. However, the orifices may have any shape, such as the shape of a polygon, oval, or irregular shape.

Figure 12:
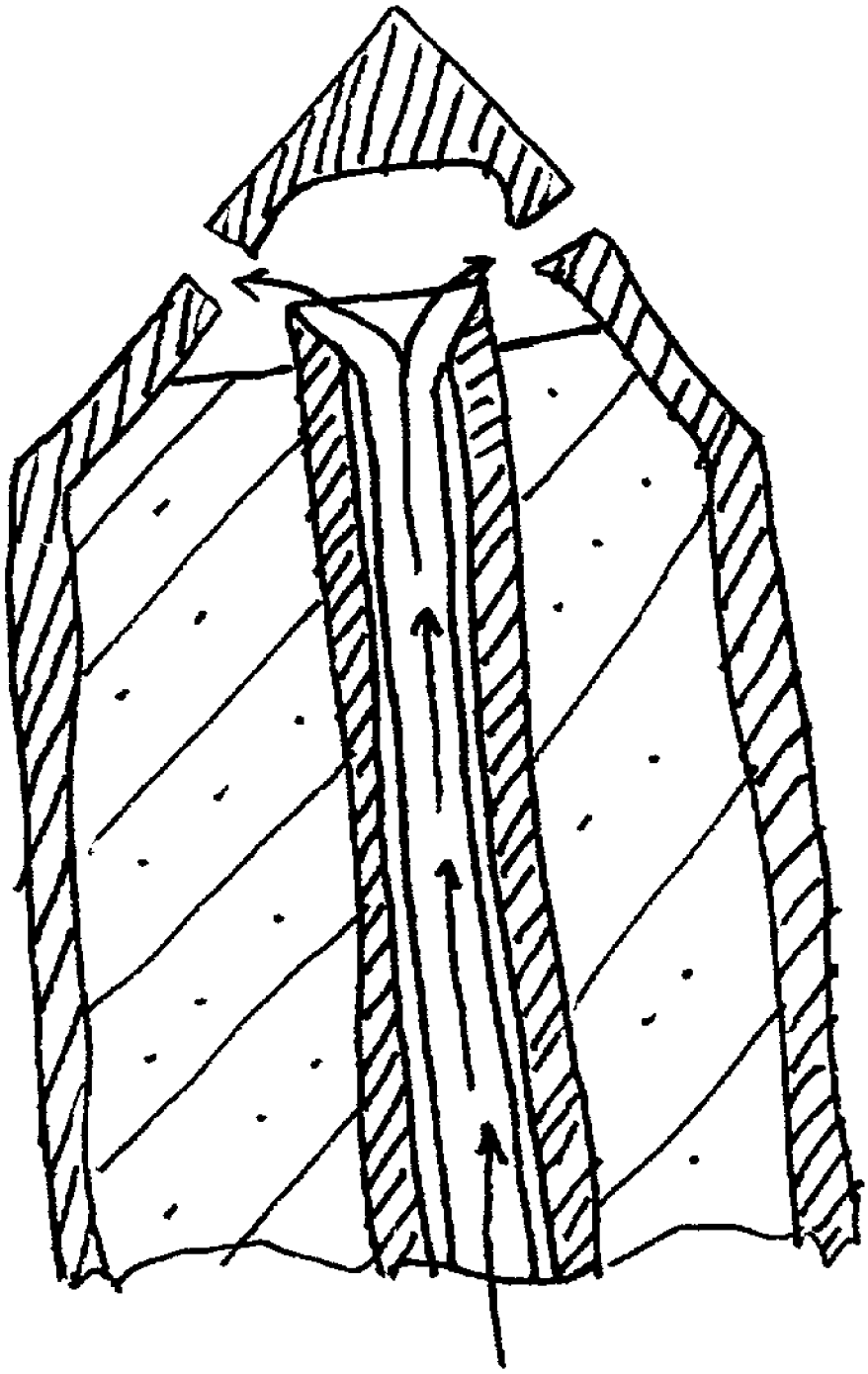
FIG. 12 is a schematic front-end view of an apparatus in accordance with another embodiment of the invention.

Further embodiments of the invention incorporate an apparatus 310 with a charge injection device 324 defining the distribution channel 344. The channel 344 may be disposed within an electrode 326. The electrode 326 is disposed within the body 311 so that an open end 385 is adjacent the forward wall 316 of the body 311. The electrode 326 has an edge 341 lying outwardly of the open end 385, adjacent the orifices 322. The channel 344 communicates with the open end 385 and the open end 385 is disposed in a forward chamber 325 in communication with the orifices 322. The channel 344 is lined with an insulating material 327 and carries fluent material past the edge 341 to the orifices 322. Without being limited to any theory of operation, it is believed that the edge 341 and channel 344 eliminates a stagnant area that may form adjacent the electrode 326 and can interfere with developing a net charge on the fluent material. In the embodiment shown in FIG. 12, the fluent material flows over the edge 341, to the orifices 322.

In electrostatic atomizers, corona induced breakdown in the vicinity of the exiting charged stream has been experienced. When a critical level of charge is reached, corona-induced breakdown occurs, charge is not imparted to the fluent material is conducted away from the fluent material by conductive materials in the apparatus, and the fluent material is not dispersed. Should it be necessary or desirable to reduce the occurrence of this phenomenon in the dispersing apparatus, the dispersing apparatus may be provided with a control-feedback system as disclosed in certain embodiments of U.S. patent application Ser. No. 09/430,633, filed Oct. 29, 1999, the disclosure of which is hereby incorporated by reference herein. Alternatively, the pulsing apparatus of certain embodiments of U.S. patent application Ser. No. 09/430,632, filed Oct. 29, 1999, the disclosure of which is hereby incorporated by reference herein, may be used to address corona induced breakdown.

The orifice may, in certain preferred embodiments, be provided with a fixture for varying the size of the orifice. The variable orifice disclosed in certain embodiments of U.S. Pat. No. 6,161,785, the disclosure of which is hereby incorporated by reference herein, may also be utilized with a dispersing apparatus in accordance with embodiments of the present invention.

Methods and apparatus in accordance with embodiments of the invention are directed to producing fibers using an apparatus having multiple orifices. A stream of a solidifiable fluid which may comprise a molten polymer or a polymer solution, is provided. The stream of solidifiable fluid is introduced into a dispersing apparatus, such as any of the apparatus discussed above. The stream flows around the electrode, which imparts a net charge to the stream. The stream is carried to the plurality of orifices, and is disrupted at least partially under the influence of the net charge. The emitter electrode and the conductive body create an electric field through which the stream of solidifiable fluid flows before exiting the orifices. The disrupted stream is allowed to solidify to form fibers.

Although the invention herein has been described with reference to particular embodiments, it is to be understood that these embodiments are merely illustrative of the principles and applications of the present invention. For example, the apparatus may have a forward wall with a concave, convex or angled shape, as opposed to the planar and conical shapes shown. In addition, apparatus in accordance with the present invention may incorporate two, three, four, or any number of orifices in an array aligned with the charge injection device. The array of orifices may be circular in shape or may have other shapes. In further embodiments, some of the plurality of orifices disperse fluent material by forcing the fluent material through some of the orifices. It is therefore to be understood that numerous modifications may be made to the illustrative embodiments and that other arrangements may be devised without departing from the spirit and scope of the invention as defined by the appended claims.

I claim:

1. Apparatus for dispersing a fluent material, comprising:

(a) a body defining a plurality of orifices arranged around in a circle a central axis;

(b) a charge injection device arranged on said central axis so that said orifices are arranged substantially equidistant from said charge injection device and said charge injection device imparts a net charge to a stream of fluent material delivered to said orifices, wherein each of said orifices has an exit on an exterior side of said body, said exits being disposed on said circle, said exits of said orifices being spaced in a radial direction from said central axis a first distance and said charge injection device is spaced in an axial direction from said exits of said orifices a second distance, said second distance being about said first distance.

2. The apparatus of claim 1, wherein said exits of said orifices are disposed in a plane.

3. The apparatus of claim 1, wherein said charge injection device comprises an electrode having an end surface disposed adjacent said orifices.

4. The apparatus of claim 3, wherein said end surface of charge injection device comprises an edge disposed in alignment with said orifices.

5. The apparatus of claim 4, wherein said edge comprises a plurality of projections with ends facing said orifices.

6. The apparatus of claim 1, wherein said body has an interior chamber and further comprising an insulator disposed in said interior chamber so as to form a forward chamber adjacent said orifices.

7. The apparatus of claim 6, wherein said charge injection device comprises an electrode mounted in said insulator.

8. The apparatus of claim 6, wherein said insulator and said body define a distribution channel leading to said forward chamber.

9. The apparatus of claim 8, wherein said body has an aperture defined therein and in communication with said distribution channel for delivering a fluent material to said distribution channel.

10. The apparatus of claim 1, wherein said charge injection device comprises an electron gun.

11. Apparatus for dispersing a fluent material, comprising:

(a) a body defining a plurality of orifices arranged in a circle around a central axis;

(b) a charge injection device arranged on said central axis so that said orifices are arranged substantially equidistant from said charge injection device and said charge injection device imparts a net charge to a stream of fluent material delivered to said orifices wherein each of said orifices has an entrance on an interior side of said body and an exit on an exterior side of said body, said entrances being positioned equidistant from said charge injection device, each of said orifices having a centerline that extends through said entrance and said exit and wherein said centerline of each of said orifices is oblique to said central axis so that said orifices have a canted arrangement with respect to said central axis.

12. The apparatus of claim 11, wherein said orifices include a first orifice on a first side of the central axis and a second orifice on a second side of the central axis opposite said first side, the center line of said first orifice intersecting the center line of said second orifice.

13. Apparatus for dispersing a fluent material, comprising:

(a) a body defining a plurality of orifices arranged around a central axis;

(b) a charge injection device arranged on said central axis so that said orifices are arranged substantially equidistant from said charge injection device and said charge injection device imparts a net charge to a stream of fluent material delivered to said orifices, wherein said body comprises a forward wall in which said orifices are formed and wherein each of said orifices has a diameter and the spacing of said orifices in said forward wall is at least about twice said diameter of each said orifice.

14. The apparatus of claim 13, wherein said forward wall comprises a planar wall arranged perpendicularly with said central axis.

15. The apparatus of claim 13, wherein said forward wall comprises a wall having a conical shape, the longitudinal axis of said conical shape being concentric with said central axis.

16. The apparatus of claim 15, wherein the spacing of said orifices in said forward wall is at least about three times said diameter of each said orifice.

17. The apparatus of claim 15, wherein said forward wall has an interior side and a recess in said interior side, said recess being disposed on said central axis, between said orifices.

18. The apparatus of claim 13, wherein said forward wall includes a notch in which said orifices are formed.

19. The apparatus of claim 18, wherein the spacing of said orifices in said forward wall is at least about four times said diameter of each said orifice.

20. The apparatus of claim 13, wherein said forward wall has an interior side and at least said interior side in-between said orifices comprises a dielectric material.

21. Apparatus for dispersing a fluent material, comprising:

(a) a body defining a plurality of orifices arranged around a central axis;

(b) a charge injection device arranged on said central axis so that said orifices are arranged substantially equidistant from said charge injection device and said charge injection device imparts a net charge to a stream of fluent material delivered to said orifices, wherein said at least one passage includes an interior space adjacent said orifices and further comprising a counterelectrode in the vicinity of said orifices and a dielectric structure disposed between said counterelectrode and said interior space, whereby said counterelectrode is electrically insulated from said interior space.

22. Apparatus for dispersing a fluent material, comprising:

(a) a body defining a plurality of orifices arranged around a central axis;

(b) a charge injection device arranged on said central axis so that said orifices are arranged substantially equidistant from said charge injection device and said charge injection device imparts a net charge to a stream of fluent material delivered to said orifices, wherein said body defines a plurality of interior spaces, each interior space having a charge injection device and a plurality of orifices associated therewith, said orifices extending through said body to said interior spaces.

23. The apparatus of claim 22, wherein said interior spaces are devoid of exposed electrically conductive surfaces other than at said charge injection device.

24. Apparatus for dispersing a fluent material, comprising:

(a) a body defining a plurality of orifices arranged around a central axis;

(b) a charge injection device arranged on said central axis so that said orifices are arranged substantially equidistant from said charge injection device and said charge injection device imparts a net charge to a stream of fluent material delivered to said orifices; and (c) a power source arranged with said charge injection device to vary the net charge imparted to the fluent material cyclically in accordance with a pattern of variation so that the net charge injected repeatedly increases and repeatedly decreases.

25. The apparatus of claim 24, wherein the net charge increases above a long-term breakdown value and repeatedly decreases below a long-term breakdown value whereby corona-induced breakdown of the apparatus is reduced.

26. The apparatus of claim 24, wherein said power source is arranged to vary the net charge imparted to the fluent material so that a higher value of net charge is imparted for a first interval and a lower value of net charge is imparted for a second interval.

27. The apparatus of claim 26, wherein said orifices include at least one first orifice closer to said charge injection device than at least one second orifice, and wherein the net charge imparted to the fluent material is varied so that the fluent material issuing from said at least one second orifice is dispersed.

28. The apparatus of claim 26, wherein said power source is arranged to vary an operating voltage applied to said charge injection device.

29. A method of dispersing a fluent material, comprising:

a) passing a fluent material out a plurality of orifices arranged around a central axis;

b) imparting the fluent material with a net charge by passing the fluent material past a charge injection device arranged on the central axis so that the fluent material passing out of each of the orifices is dispersed under the influence of the net charge, wherein the step of applying a net charge includes varying the net charge so that the net charge imparted to the fluent material repeatedly increases and decreases.

30. The method of claim 29, wherein the net charge is varied so that a higher value of net charge is imparted to the fluent material for a first interval and a lower value of net charge is imparted to the fluent material for a second interval.

31. The method of claim 29, wherein varying the net charge includes varying an operating voltage applied to a charge injection device.

32. The method of claim 29, wherein the orifices include at least one first orifice closer to said charge injection device than at least one second orifice and the net charge is varied so that the fluent material issuing from said at least one second orifice is dispersed.

* * * * *